United States Patent [19]

Häusser

[11] Patent Number: 4,508,302

[45] Date of Patent: Apr. 2, 1985

[54] FURNITURE FITTING

[75] Inventor: Horst Häusser, Rudersberg, Fed. Rep. of Germany

[73] Assignee: Horst Häusser Metallwaren GmbH, Rudersberg, Fed. Rep. of Germany

[21] Appl. No.: 421,980

[22] Filed: Sep. 23, 1982

[30] Foreign Application Priority Data

Dec. 31, 1981 [DE] Fed. Rep. of Germany ..... 3151986

[51] Int. Cl.[3] ..... E04G 3/00

[52] U.S. Cl. ..... 248/297.3; 248/125; 248/132; 248/295.1; 182/146

[58] Field of Search ..... 248/297.3, 297.2, 295.1, 248/243, 132, 161, 157, 218.4, 244, 125; 182/146

[56] References Cited

U.S. PATENT DOCUMENTS

| | | | |
|---|---|---|---|
| 1,539,211 | 5/1925 | Scruggs | 248/297.3 |
| 1,725,809 | 8/1929 | Lewis | 248/297.3 |
| 1,947,165 | 2/1934 | Nelke | 248/297.3 |
| 3,473,774 | 10/1969 | Riblet | 182/146 |
| 4,250,647 | 2/1981 | Woodard | 248/297.3 |

*Primary Examiner*—William H. Schultz
*Assistant Examiner*—Ramon O. Ramirez
*Attorney, Agent, or Firm*—Burmeister, York, Palmatier, Hamby & Jones

[57] ABSTRACT

The invention relates to a furniture fitting having a grooved loop-shaped guideway for guiding an equipment supporting plate in a generally vertical direction and locking it in at least two positions at different elevations. Means are provided for preventing a guide pin from entering at least one of the two guideway branches from the undesired direction. The invention resides in the sections (28, 35, 40, 29, 51, 52, 48) of the grooved guideway being provided with steps having steeply rising surfaces (33, 38, 41, 43, 53), the pin end (32) moving in the grooved guideway being urged against the bottom of the groove by spring means (21, 62), and the rising surfaces of the steps forming stops for the pin end (32) in one direction of movement.

7 Claims, 8 Drawing Figures

FURNITURE FITTING

FIELD OF THE INVENTION

This invention relates to a device in the form of a furniture fitting for guiding an equipment supporting plate in a generally vertical direction and locking it in at least two positions at different heights. One of the two parts (plate and column) moving relative to each other during vertical motion is provided with a pin and the other is provided with a grooved generally loop-shaped guideway, including two branches, for admitting the pin end. In at least one upper locking position, the equipment carrying plate is being supported from below by the pin and the side portion of a guide surface. Means are provided which prevent the pin from entering into at least one of the two grooved loop branches from the undesirable direction.

BACKGROUND OF THE INVENTION

In prior fittings of this type, as they are disclosed in German Pat. No. 820,794, for example, the grooved guideway is in the shape of a closed, approximately L-shaped loop and is attached to the column. In the lower locking position, the pin attached to the plate is resting in the lowermost point of the grooved guideway. As the plate is lifted, the pin on the plate moves upward in one branch of the grooved loop until it hits a stop whereby the movement in this direction is terminated. At the subsequently executed movement toward one side and slightly downward, the pin arrives at a locking position in which the equipment plate is in its upper position. If the equipment plate is desired to be lowered again, the plate must first be lifted out of this latched upper position and moved sideways before it can move into the other branch of the guideway, after bypassing the previously mentioned stop, to again arrive at the lower locking position. Thus, either the pin alone or the entire equipment plate must not only be moved vertically up and down, but also sideways, i.e. at least the pin if not the entire plate. This is particularly annoying when attempting to have the pin enter the upper locking position and a certain amount of dexterity is required to execute this maneuver and prevent the pin from sliding back in the same guideway branch into its lower position.

Furniture fittings are known in which the pin is prevented from an uncontrolled entering into the grooved sections by flexible switching means. However, the flexibility of such switch tongues is frequently impaired by dirt or debris so that they require a certain amount of maintenance. For this reason, such switch tongues permitting a controlled insertion of the pin into the desired section of the guideway are not widely in use.

SUMMARY OF THE INVENTION

It is the object of present invention to provide a device for an easy vertical adjustment of equipment carrying plates forming part of a piece of furniture, the construction of which is uncomplicated and the manufacture simple.

This is accomplished according to the invention in that the interior of a grooved guideway in a latching plate is provided with steps having steeply rising surfaces, that the pin moving in the grooved guideway is urged against the steps by a spring, and that the rising surfaces of the steps form stops for the pin in one direction of movement. This prevents the pin, after reaching one position in one direction of movement, from moving back in the same grooved section, so that it is compelled to move on into the next following section of the grooved guideway. It is therefore no longer necessary to make provision for the pin or the plate to move sideways before being able to move into the upper latching position, for example, in order to put the pin in the position in which it will support the plate in the upper locking position.

The invention has the further advantage that the device is operative without movable parts in the guideway and thus requires no maintenance.

The steep or rising surfaces function as stops for movement in the undesired direction, with the pin being urged against the steps by the action of a spring, so that the pin is able to negotiate the rising surfaces in the desired direction of movement, but is unable to overcome the rising surfaces in the undesired direction of movement.

The steps may be provided at the side portions of the grooved guideway, with a spring urging the pin end against the side portion to enable the pin end to move over the steps in one direction of movement, whereas in the other direction of movement the rising surface of the step forms a stop for the pin to prevent it from moving on.

In another embodiment of the invention, at least one step is provided at the bottom of the groove. This makes for a particularly simple design of the device which is especially easy to manufacture. In this embodiment, the pin is maintained in engagement with the bottom of the guide groove by a spring.

The tread or horizontal surface of a step normally at an approximately right angle to the riser or vertical surface of the step may in some embodiments of the invention lie in the plane of the direction of movement, but may also extend at an angle to the direction of movement. The latter embodiment has the advantage that in cases in which several steps are provided in grooved sections of the guideway, the depth of the groove may be approximately the same at the foot of each rising surface, decrease along the horizontal surface and past the rising surface again increase abruptly to resume the depth it had at the preceding rising surface.

The rising surfaces may be oriented at right angles to the direction of movement of the pin in the grooved section into which it is not supposed to enter. In one embodiment of the invention, however, the rising surfaces extend in the direction of the side walls of the succeeding groove section so that the pin arriving at a rising surface slides along it and into the adjacent groove section where it is being moved on. This ensures an especially facile movement of the pin in the guideway, because, while preventing the pin from entering the wrong section, the rising surfaces deflect the movement of the pin into the direction of the guideway section which it is supposed to enter and in which it is then being advanced. Due to this particular feature, in many cases no spring is necessary to cause the pin, at a change in the direction of movement, to enter into another guideway section.

In one embodiment of the invention, several grooved sections are provided to form a generally loop-shaped guideway, each grooved section being associated with individual locking positions of the equipment plate. The bottom end of the loop-shaped guideway merges into a section directed downwardly, and the top end of the loop merges into a guide section directed upwardly. Both of these guide sections are passable in either direction. This embodiment has the advantage that the grooved guideway sections which are associated with a particular latching position of the equipment plate may be interconnected by way of these guide sections provided at the bottom and top of the guideway and being passable in both directions so that it is possible to adjust the equipment plate and lock it in a plurality of vertically disposed rest or locking positions.

In some embodiments of the invention, the pin not only is resiliently urged against the bottom of the guide groove, but the pin is also subjected to the action of springs tending to keep the pin in an intermediate position between the two branches of the guideway.

Further objects, advantages and features of the invention will become apparent from a description of several embodiments in conjunction with the claims and the drawings. The individual features of the invention may be realized each by itself or in combination, in various embodiments of the invention.

DETAILED DESCRIPTION OF ILLUSTRATIVE EMBODIMENT

Figure 1:
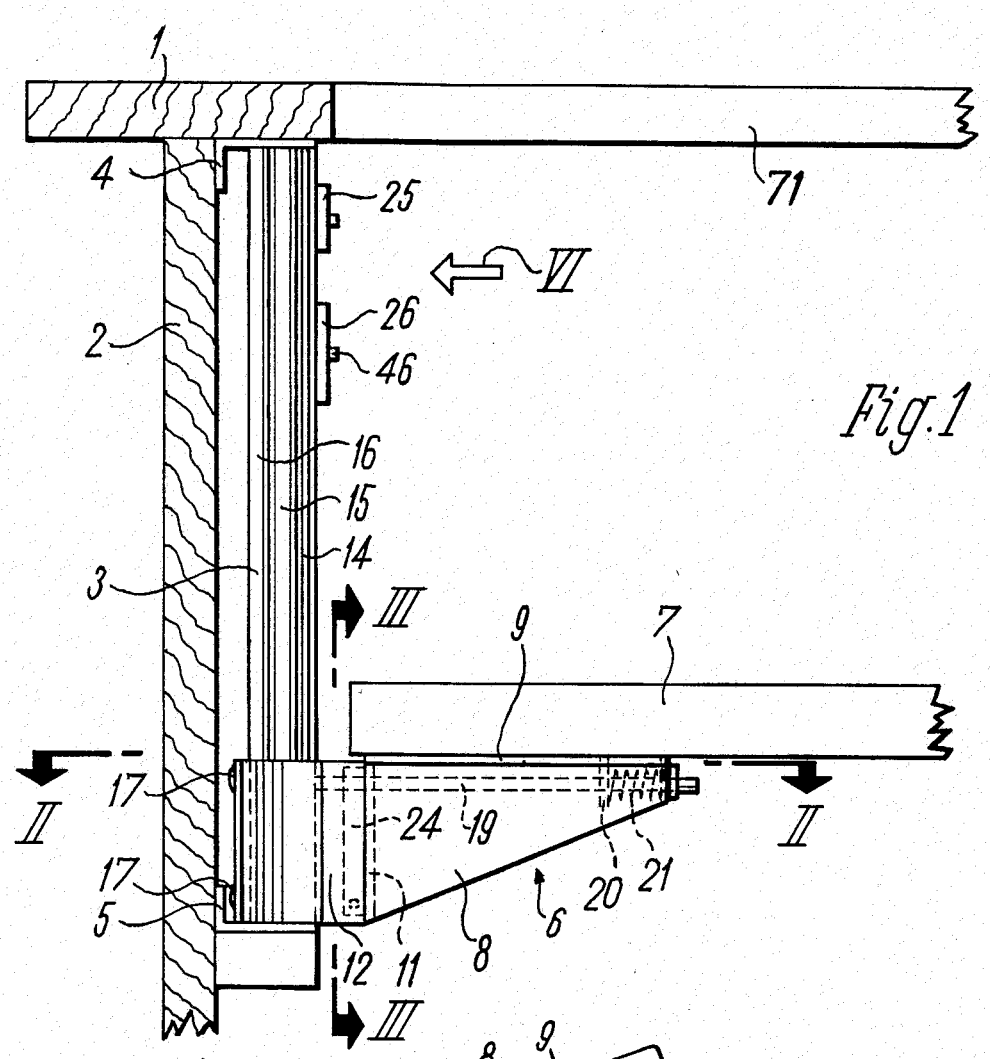
FIG. 1 is a side view, partly in section.
Figure 2:
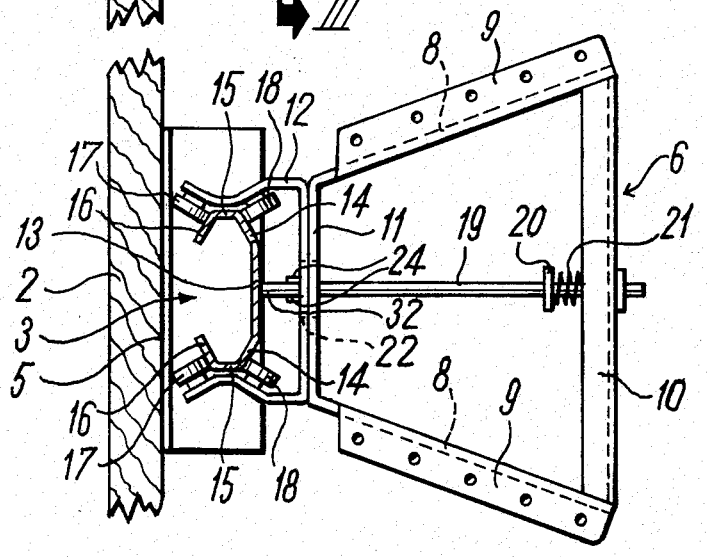
FIG. 2 is a sectional view along the line II—II of FIG. 1.

A side wall 2 supporting a table top 1 has secured thereto by means of angular brackets 4 and 5 a vertical column 3 consisting of a metal section which is C-shaped in cross-section. Mounted on the column 3 is a carriage 6 adapted to be slidably displaceable in the vertical direction. Fastened to the carriage 6 is a plate 7 for supporting equipment such as a sewing machine, for example, or the like. The plate 7, however, may also be used for other purposes and may on each side be guided along a column 3. The table top 1 has an opening 71 therein which corresponds in size to the size of the plate 7. The carriage 6 has side portions 8 for supporting the plate 7. The upper edge portions of the side walls 8 are angularly bent off to form horizontal fastening flanges 9. At the side facing away from the column 3, the carriage 6 is provided with an outer connecting bar 10 and at the side facing the column 3, the carriage 6 has an inner connecting bar 11. The inner connecting bar 11 is fastened to a member 12 substantially U-shaped in cross section, the middle portion of which faces the bar 11 and the side portions embrace the column 3.

Diverging at an angle from the mid section or yoke of the C-shaped cross-section of the column 3, facing the carriage 6, are portions 14 which in turn merge with portions 15 extending at approximately right angles to the mid portion 13 of the C-shaped column 3. The end portions 16 of the C-column point inwardly at an angle of less than 90°. The exterior surfaces of the portions 16 form guiding surfaces for rollers 17 which are rotatably mounted on the free ends of the U-shaped member 12. The exterior surfaces of the portions 14 of the C-column 3 form guiding surfaces for rollers 18 which are also mounted on the side portions of the U-shaped member 12, but at a distance from the ends thereof. The side portions of the U-shaped member 12 are angularly curved in such a manner that the axes of the rollers 17 and 18 extend about parallel to the portions 14 and 16. By virtue of the rollers 17, 18 and the sections 14, 16, the carriage 6 is capable of being moved along the column 3 without play.

Inserted in the carriage 6 is a rod or pin 19 for longitudinal slidable displacement. The end of the rod or pin 19 distal from the column 3 is mounted in a bore in the outer connecting bar 10 with a slight amount of play. A spring 21 bearing against the bar 10 on one side and against a disc 20 on the pin 19 on the other side causes the pin 19 to move toward the column 3. The part of the pin 19 proximal to the column 3 is slidable in an opening 22 transversely to its longitudinal axis. The opening 22 is approximately horizontally directed. Secured to the inner connecting bar 11 at a distance from the opening 22 are the ends 23 of bar springs 24, the free ends of which embrace the pin 19 from both sides so as to keep it centered in the opening.

In the lowermost position of the equipment plate 7, the carriage 6 is supported by the angular bracket 5.

Mounted on the column 3 are latch plates 25 and 26 adapted to be adjustable as to height and locked in position for two vertically spaced upper rest or locking positions of the plate 7. The latch plates 25 and 26 have guide grooves milled therein in a pattern forming an approximately heart-shaped loop.

The plate 25, at its lower edge, has a generally funnel-shaped guide section 27 from which two branches 28 and 29 of the grooved guideway are diverging into the interior, first turning somewhat sideways in the lower half of the guideway, before converging in the upper half of the guideway to outline a generally heart-shaped configuration, leaving a plane center portion 30 enclosed by the grooved branches 28 and 29 of the guideway.

The upper edge 31 of the center portion 30 is curved and forms a stop for the end 32 of the pin 19 when the carriage 6 is in its uppermost locking position. The depth of the guideway branches 28 and 29 is not uniform throughout their entire length. The guideway section 27 has its greatest depth at the edge of the plate 25 and at this level merges into the branch 28, the depth of which diminishes as it advances into the interior of the plate 25, i.e. in the upward direction as viewed in FIG. 6. In the groove 28, approximately at the level above a center portion 30, is located a rising surface or drop-off 33. When the pin end 32 has moved over or past the rising surface 33, it comes to bear against the side wall 34 of the groove and the upward movement of the pin end 32 in the branch 28 is completed. Following the grooved branch 28 is a downwardly leading section 35 for guiding the pin end 32 until it abuts the side wall 31 and there assumes a rest position. The rising surface 33 represents the extension of the flank forming the end of the grooved section 35. When the pin end 32 bears against the flank 34, it has already moved over the rising surface 33 and with its leading end engages the inclined surface 37.

Figure 6:
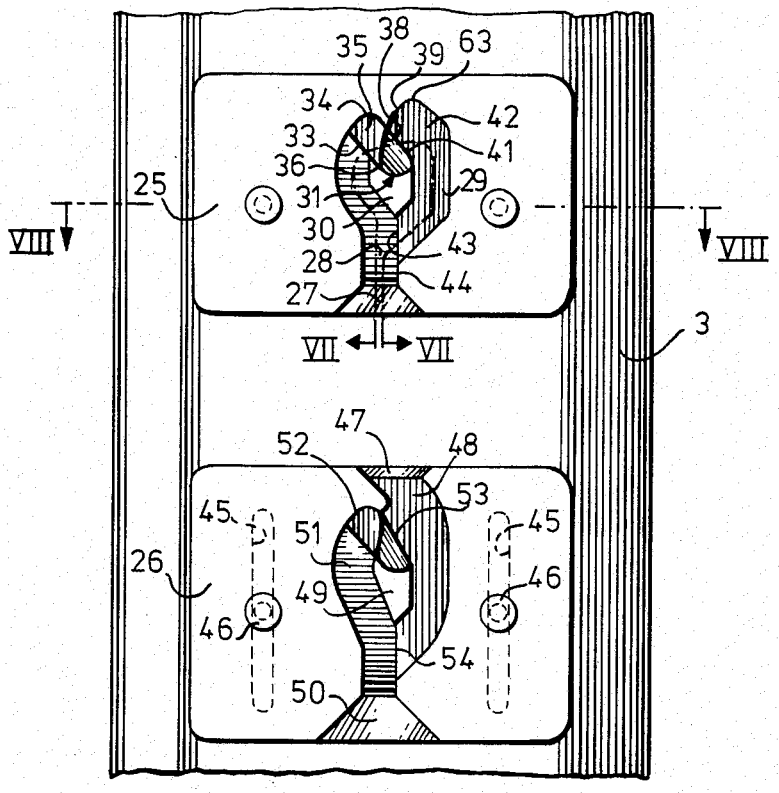
FIG. 6 is a view in the direction of the arrow VI in FIG. 1 in a larger scale than FIG. 1.
Figure 7:
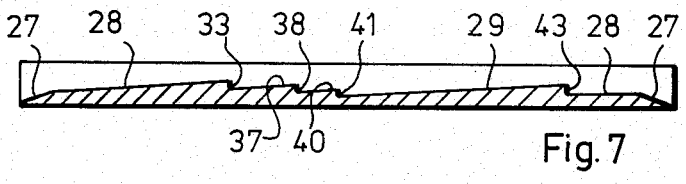
FIG. 7 is a developed sectional view along the broken line VII—VII of FIG. 6, "this view representing the appearance of the section if cut along the broken line and then flattened or straightened out."
Figure 8:
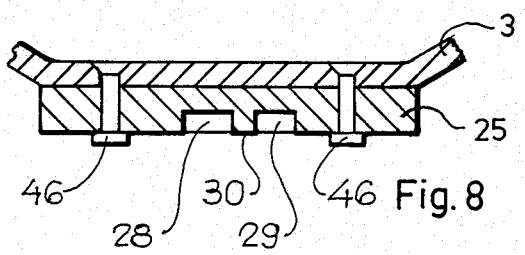
FIG. 8 is a horizontal sectional view along the line VIII—VIII of FIG. 6.

The guideway section 35 is divided by a rising surface or drop-off 38 approximately as an extension of the side wall 39. In this part of the guideway, the section 35 is deepest along the rising surface 33; its depth gradually diminishes until it reaches the height of the upper edge of the rising surface 38. After the pin end 32 has moved over or past the rising surface 38, it comes to rest on the inclined surface 40, which again is deepest at the foot of the step 38 and is shallowest at the head of the rising surface or drop-off 41 forming an extension of the side wall 34. When the pin end 32 engages the surface 40, it is at a location halfway between the steps 38 and 41. Following the guideway section 31 is the guideway section 42, again leading upward out of the latching position 31, and whose side portion or flank 63 forms a stop for the pin 32 being advanced upwardly. The next following section is the branch 29, in which the pin end 32 again is guided downwardly into the lower part of the branch 28, the branch 29 merging with the branch 28 at a stop or drop-off 43. In FIG. 6, the rising surface 43 is an extension of the flank 44 defining the branch 28.

When the pin end 32 enters the grooved guideway through the section 27, it is directed by necessity into the branch 28 because the rising surface 43 bars the pin 32 from entering into the branch 29. Having passed over the rising surface 33, the pin comes to bear against the upper end of the branch 28, i.e. the flank 34, whereupon the plate 7 can again be lowered. During this lowering operation, the pin end 32 is caused to move along the rising surface 33 in the guideway section 35 downwardly toward the stop 31 and the rising surface 33 bars the pin end 32 from entering the branch 28.

During the downward movement, the pin end 32 moves over the rising surface 38 which prevents the pin end 32 from engaging the inclined surface 37 when the plate 7 is raised again and by which it is guided toward the upper abutment 63, passing over the rising surface 41. When the plate 7 is lowered again, the rising surface 41 prevents the pin end 32 from engaging the surface 40 and urges the pin into the branch 29, the depth of which progressively decreases from the rising surface 41 to the rising surface 43 at the lower end of the guideway branch 29. Having passed over the rising surface 43, the pin end 32 again arrives in the lower portion of the branch 28. From there it may proceed at the same level along the transitional portion between the guideway branch 28 and the guideway section 27 and again enter the section 27 and exit therefrom in the downward direction.

The plate 26 is guided along the column 3 and is height adjustable by screws 46 fitting into elongate slots 45 vertically disposed in the column 3 and, upon being tightened, securing the plate 26 against displacement on the column 3. The latch plate 26 is provided with a substantially identical grooved generally loop-shaped guideway as the latch plate 25, except that the guideway of the latch plate 26 has a guide section 47 also in its upper edge portion which otherwise is similar to the guide section 27. The upper end of the guideway branch 48, corresponding to the guideway branch 29 of the plate 25, merges at the same level into the guide section 47. The upper edge of the plane center portion 49 between the grooved sections of the guideway again forms a stop for the pin end 32 in the rest position. Thus, the latch plate 26 affords a locking position for the equipment plate 7 between its lower position, in which it is supported by the bracket 5, and its upper position which is determined by the latch plate 25 and the edge of the center portion 31.

As the equipment plate 7 is lifted out of its latched position, the pin end 32 moves through the guide section 50 into the guideway section 51 of the latch plate 26, is stopped by the edge portion 52 and, upon being deflected in the direction of movement, bears against the upper edge of the center portion 49, so that the equipment plate 7 is locked at this height. To change the position of the plate 7, the plate 7 is lifted somewhat so that the pin end 32 can enter the upper part of the guideway branch 48. If it is desired to move the plate 7 to the next higher position, the upward movement of the plate 7 continues with the pin end 32 leaving the latch plate 26 through the guide section 47 and entering the latch plate 25 through the guide section 27 to proceed to the guideway branch 28 and on to the abutment 31. If, however, the plate 7 is not to be moved from the middle position into the uppermost position, the plate 7 will be lowered after the pin end 32 has passed over the rising surface 53, and finally over the rising surface 54 into the lower part of the guideway branch 51 and from there into the guide section 50 where it assumes its lowermost position in which the carriage with the plate 7 thereon is supported by the angular bracket 5.

The primary purpose of the springs 24 is to retain the pin end 32 centered between the two latch plates 25 and 26 so that the pin end 32, upon leaving the guide section 47, is securely guided into the guide section 27 of the upper latch plate 25. The spring is not necessary for guiding the pin in the guideway; rather, it is sufficient that the pin end 32 is movable in a horizontal plane transversely to its longitudinal axis.

Figure 3:
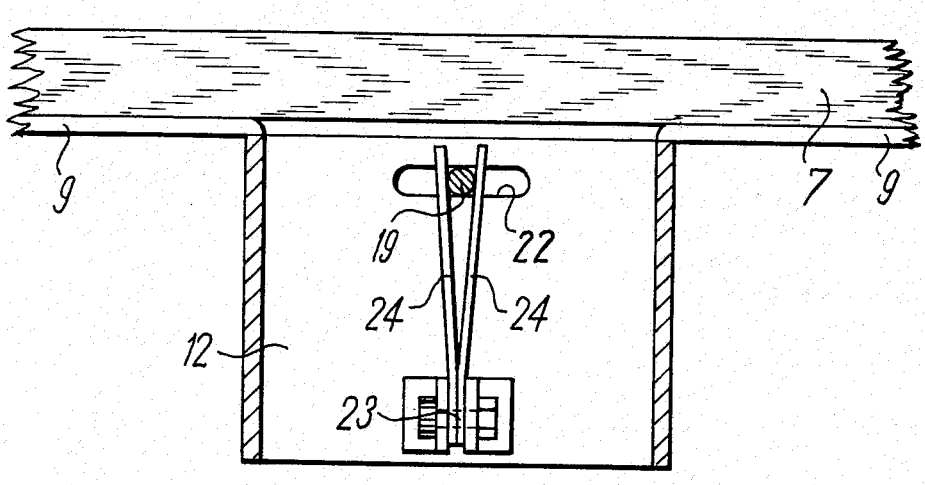
FIG. 3 is a sectional view along the line III—III of FIG. 1 in an enlarged scale.
Figure 4:
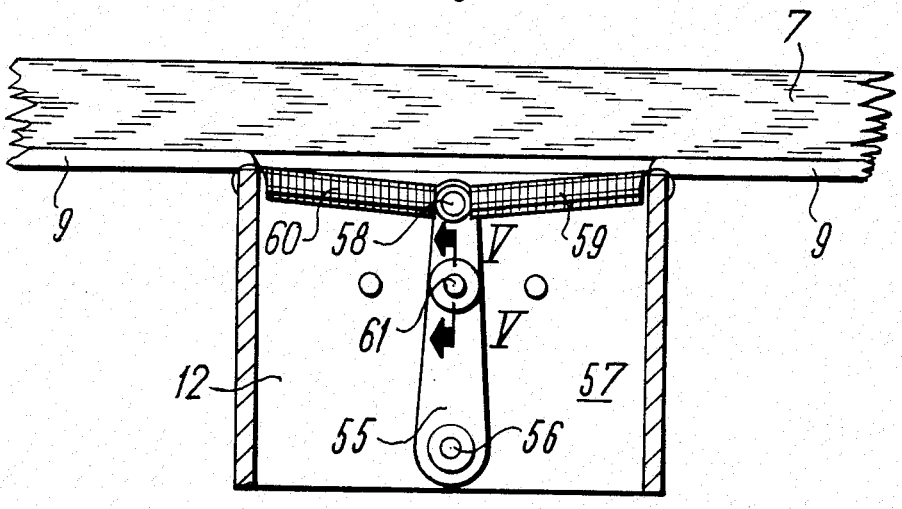
FIG. 4 shows another embodiment of this detail.
Figure 5:
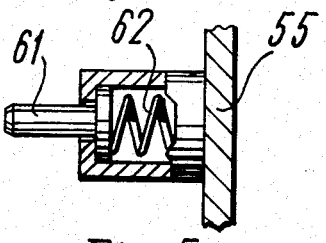
FIG. 5 is a sectional view along the line V—V of FIG. 4 in an enlarged scale.

The embodiment of FIG. 4 is distinguished from the embodiment of FIG. 3 merely by the pin end 61 being attached near the end of a latch 55 which is pivotable about a shaft 56 on the mid portion or yoke 57 of the U-shaped member 12. Secured to the extreme end of the latch 55 is a bolt 58 which is acted upon by two springs 59 and 60, the other ends of which engage the side walls of the U-shaped member 12 and in this manner hold the pin end 32 in the median plane.

In this embodiment, the section of the pin 19 between the outer connecting bar 11 and the inner connecting bar 10 is omitted, but also here, the pin end 61 is urged against the groove bottom by a spring 62 to ensure a close engagement of the pin end 61 with the groove bottom at all times.

The vertically adjustable mechanism of the invention is suitable not only for sewing machines, but may be used for any equipment in need of being vertically moved and locked into position at various elevations and unlocked and lowered again by a simple lifting and lowering operation of the plate supporting such equipment.

I claim:

1. Device in the form of a furniture fitting for guiding an equipment supporting plate in a generally vertical direction and locking it in at least two positions at different heights, in which one of the two parts, namely plate and column, moving relative to each other during vertical motion is provided with a pin and the other is provided with a grooved generally loop-shaped guideway having two branches, for admitting the end of the pin, the equipment carrying plate in at least one upper locking position being supported from below by the pin and the side portion of a guide surface, and means for preventing the pin from entering into at least one of the two grooved guideway branches from the undesired direction, characterized in that in the sections (28, 35, 40, 29, 51, 52, 48) of the grooved guideway steps are provided having steeply rising surfaces (33, 38, 41, 43, 53), that the pin end (32) moving in the grooved guideway is urged against the bottom of the groove by spring means (21, 62), and that the rising surfaces of the steps form stops for the pin end (32) in one direction of movement.

2. Device according to claim 1, characterized in that the steps (33, 38, 41, 43, 53) are located at the bottom of the groove of the guideway sections (28, 35, 42, 29, 51, 48).

3. Device according to claim 1 or 2, characterized in that the steps are at least in part comprised of inclined surfaces (28, 37, 40) and steeply rising surfaces.

4. Device according to claim 1 or 2, characterized in that the steeply rising surfaces (33, 38, 41, 43) have the same direction as the side walls (36, 39, 34, 44) of the adjacent groove sections.

5. Device according to claim 1 or 2, characterized in that a plurality of grooved sections are provided to form a generally loop-shaped guideway, each grooved section being associated with a particular locking position of the equipment plate (7), and that the bottom end of the loop-shaped grooved guideway merges into a downwardly directed guide section (27, 50) and the top end of the guideway merges into an upwardly directed guide section (47), both of these guide sections (27, 47) being passable in either direction.

6. Device according to claim 1 or 2, characterized in that the pin end (32, 61) is slidably movable transversely to the direction of the vertical height adjustment movement and is retained in its center position by springs (29, 59, 60).

7. Device according to claim 1, characterized in that the steps are arranged at the flank of the grooved guideway and the pin end is urged into engagement with said flank by spring means.

* * * * *